United States Patent [19]

Pont

[11] 4,302,179

[45] Nov. 24, 1981

[54] BURNER HOLDER WITH QUICK RELEASE AND LOCKUP MECHANISM

[75] Inventor: Richard S. Pont, Edinburgh, Scotland

[73] Assignee: Laidlaw, Drew & Co. Ltd., Edinburgh, Scotland

[21] Appl. No.: 53,137

[22] Filed: Jun. 28, 1979

[51] Int. Cl.[3] ..... F23C 5/06

[52] U.S. Cl. ..... 431/189; 239/265; 239/280.5

[58] Field of Search ..... 431/186, 189; 239/265, 239/280.5

[56] References Cited

U.S. PATENT DOCUMENTS 3,100,461 8/1963 Werner ..... 431/189

*Primary Examiner*—Carroll B. Dority, Jr.

*Attorney, Agent, or Firm*—Sprung, Felfe, Horn, Lynch & Kramer

[57] ABSTRACT

A furnace firing system including a furnace port, a burner including a nozzle at one end received in the port and a mounting for the burner to position the nozzle in the port at a desired firing angle. The burner comprises an elongated body having a frustoconical locating member fixedly mounted therearound adjacent the other end of the burner and tapering towards the one end. The mounting is connected to the burner solely at the locating members via a receiving member having the inner surface thereof configured to closely receive the locating member. The locating member is releasably retained in the receiving member and the burner is pivoted about a pivot axis disposed between the locating member and the nozzle and substantially adjacent the nozzle by a pivot arm extending between the pivot axis and the receiving member and connected to the receiving member at one end. A base and a mounting member connected to the base at one end and pivotally connected at its other end to the other end of the pivot arm at the pivot axis, enable the pivot arm to pivot about the pivot axis with respect to the mounting member.

6 Claims, 3 Drawing Figures

BURNER HOLDER WITH QUICK RELEASE AND LOCKUP MECHANISM

BACKGROUND OF THE INVENTION

The present invention relates to a furnace firing system of the type having a furnace port and a burner including a nozzle at the end thereof received in the port and more particularly to the means for mounting the burner to position the nozzle in the port at a desired firing angle.

Burners and their burner holders are known in the prior art, however, these systems either have the disadvantage of being overly complex and therefore expensive to produce and maintain or too simple and therefore not providing a high degree of resolution of movement of the burner nozzle at the furnace port without a great deal of manipulation and difficulty.

Examples of the prior art burners and burner holders are exemplified by the burner structure disclosed in U.S. Pat. No. 2,338,623 wherein a burner is held at two points along the length thereof and pivoted about a point which is at a great distance from the nozzle end of the burner. This has the disadvantage of producing a great deal of angular deflection of the nozzle in response to a small adjustment of the pivot angle whereby further height adjustments of the nozzle must be effected in order to obtain the desired firing angle.

Another example of the prior art is the GT oil burner and mounting bracket produced by the Laidlaw Drew Company which comprises a sextant type mounting which effects a virtual pivot axis at the burner nozzle tip. While this type of mechanism represents the ultimate desirable positioning of the burner nozzle for the firing angle adjustment thereof, this is obtained at a high cost and in view of the necessity for a large number of these burners and mounting brackets to be used in a furnace system, the cost may render the use of the device impractical.

SUMMARY OF THE INVENTION

It is therefore the object of the present invention to provide a burner and mounting therefor which overcomes the disadvantages of the prior art while substantially retaining the advantages thereof.

These and other objects of the invention are obtained in a furnace firing system comprising a frustoconical locating member fixedly mounted around the elongated body of the burner and adjacent the end of the burner opposite the nozzle and which tapers towards the nozzle end of the burner and wherein the mounting therefor comprises means connecting to the burner solely at the locating member comprising a receiving member having the inner surface thereof configured to closely receive the locating member, means for releasably retaining the locating member in the receiving member and means for pivoting the burner about a pivot axis disposed between the locating member and the nozzle and substantially adjacent the nozzle comprising a pivot arm extending between the pivot axis and the receiving member and connected to the receiving member at one end, a base and a mounting member connected to the base at one end and pivotally connected at its other end to the other end of the pivot arm at the pivot axis to enable the pivot arm to pivot about the pivot axis with respect to the mounting member.

In a preferred embodiment, the system also comprises means connected between the pivot arm and the base for adjusting the angular position of the pivot arm about the pivot axis and thereby that of the burner nozzle and means for adjusting the height of the base and thereby that of the burner nozzle.

These and other features, objects and advantages of the present invention will become apparent from the following specification when read in connection with the accompanying drawings wherein:

DETAILED DESCRIPTION OF THE INVENTION

Figure 1:
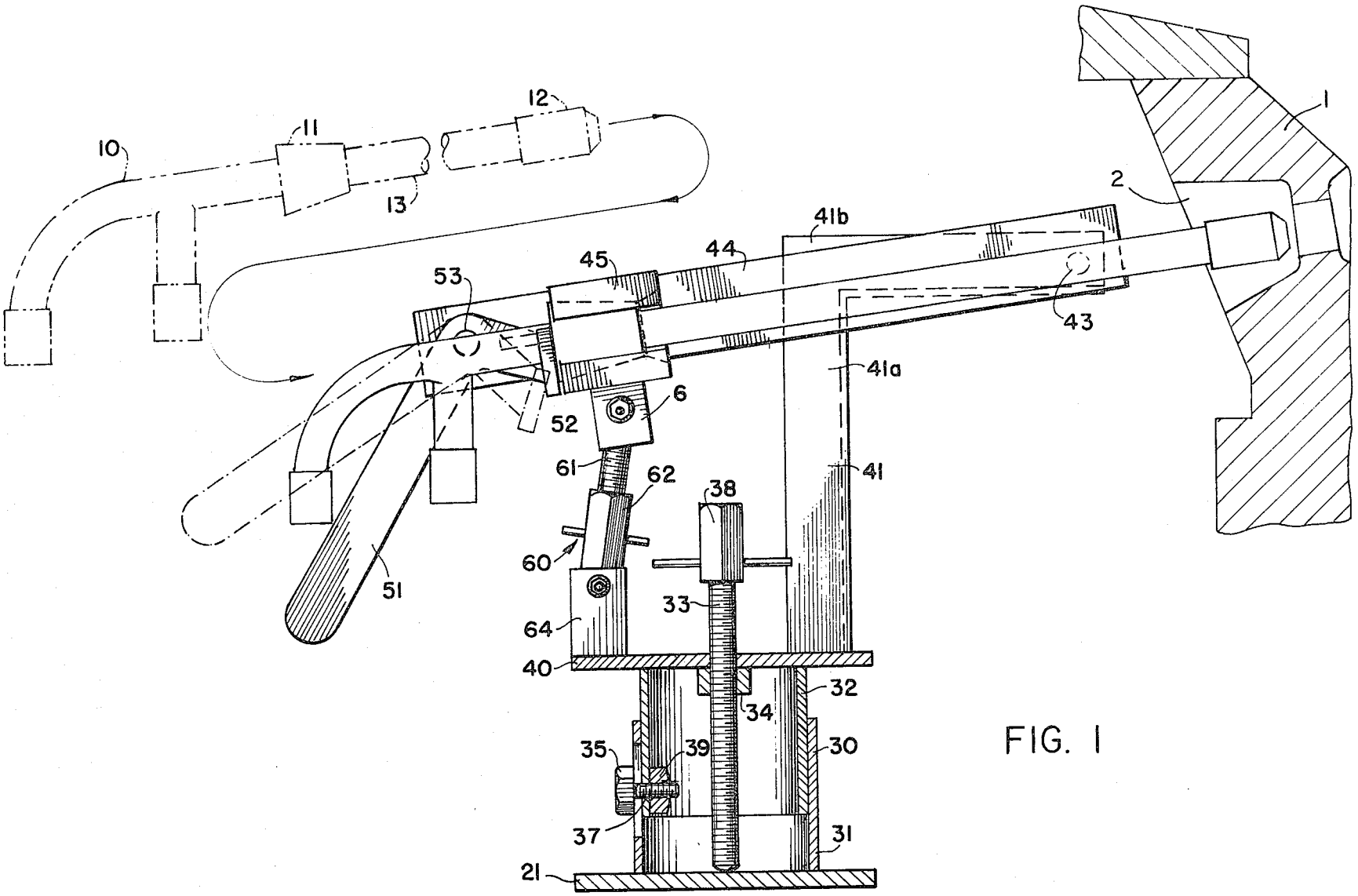
FIG. 1 is a cross sectional side view of the system according to the present invention.
Figure 2:
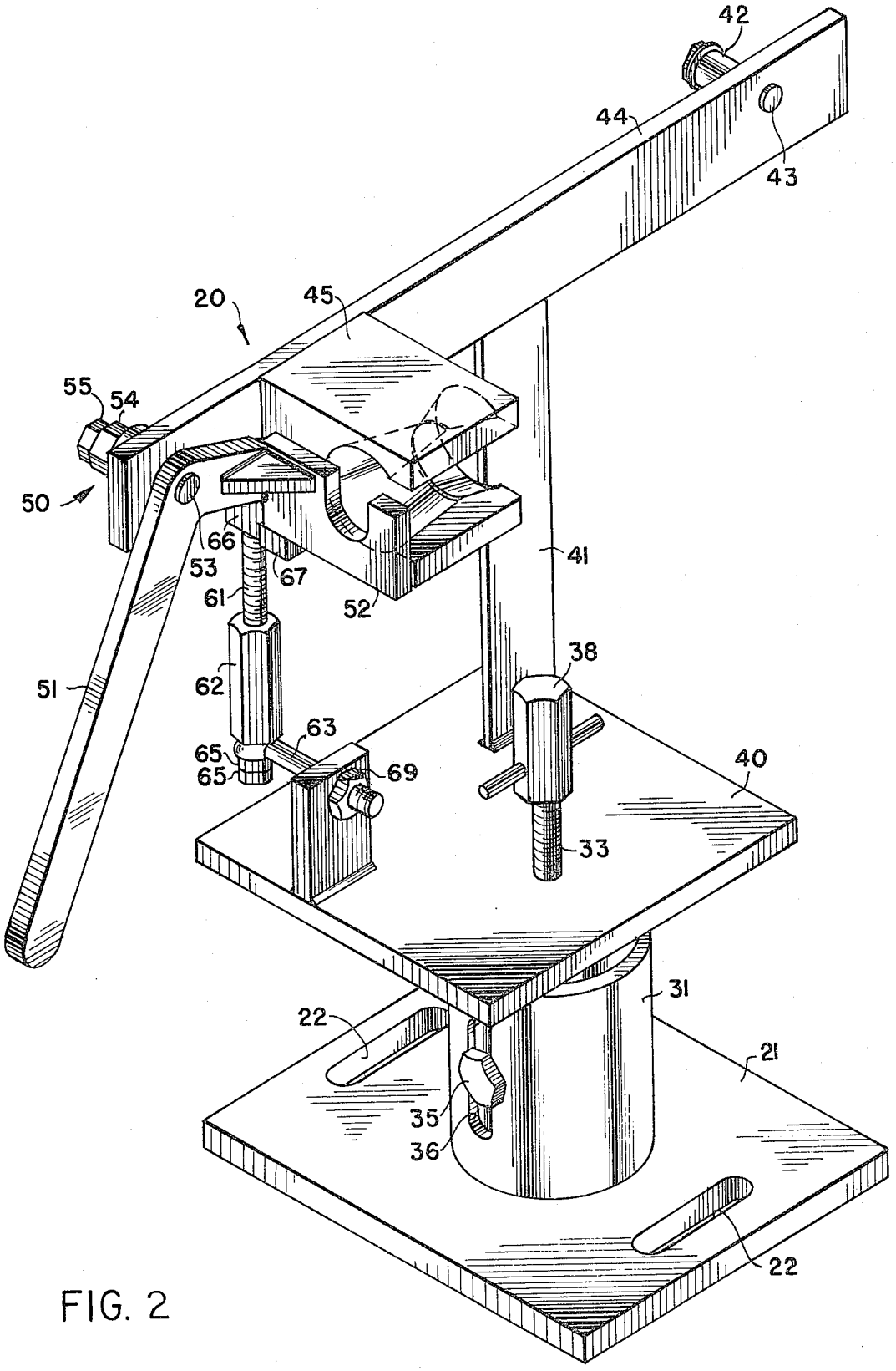
FIG. 2 is a perspective view of the mounting for the burner of the present invention.
Figure 3:
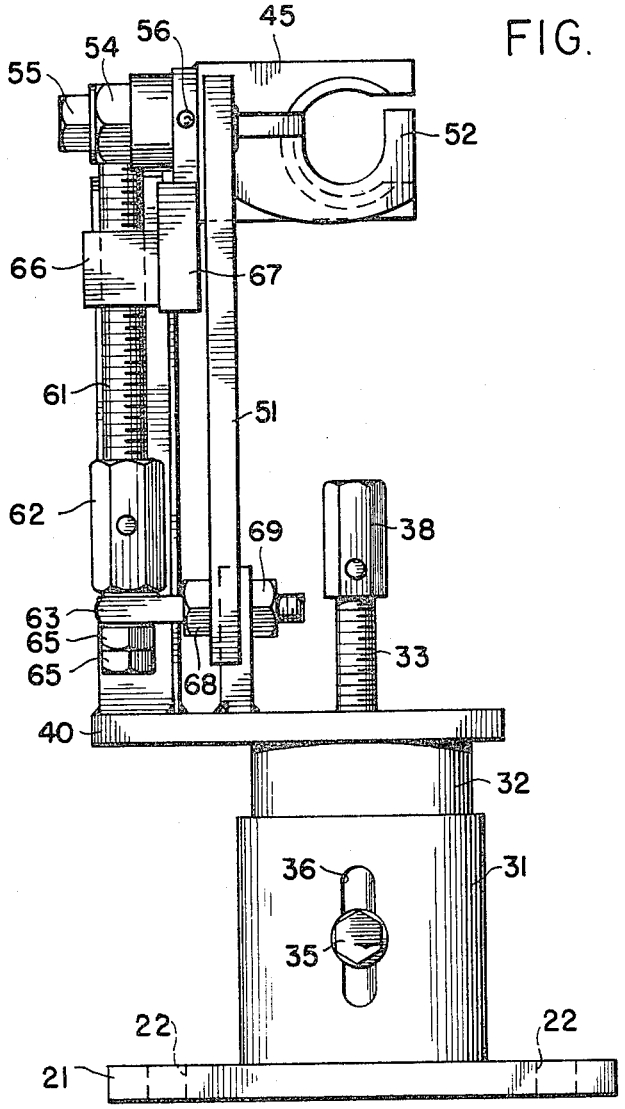
FIG. 3 is a side view of the mounting of FIG. 2.

Referring now to FIGS. 1–3, the relative positioning of the burner mounting 20 is shown with respect to the furnace wall 1 having a port 2 therein. The burner 10 which includes an elongated body 13 terminating in a nozzle 12 and having a frustoconical locating member 11 thereon at the end portion opposite the nozzle end, is inserted into the burner mounting 20 to effect the positioning of the burner nozzle 12 in the furnace port 2. Since for different applications, it is desirable to have different firing angles, i.e., the burner nozzle angle with respect to the longitudinal axis of the port is different, the burner mounting 20 must have the ability to adjust the angle of the burner nozzle in the furnace port 2. Additionally, since the burners 10 in a furnace system must be serviced at periodic intervals, the insertion and removal of the burner 10 from the mounting 20 should involve as little technical expertise on the part of the operator as possible and should be able to be done quickly in view of the many burners 10 used in a typical furnace system.

In order to effect the adjustment of the firing angle of the burner nozzle 12, it has been found that it is necessary to both change the angular orientation of the nozzle 12 and the height thereof to obtain the full range of desired positions.

The burner mounting 20 comprises a mounting plate 21 which is mounted in the horizontal plane by means of slots 22 which are receptive of mounting bolts or the like and which permit adjustment in the horizontal plane. Spaced parallel above the mounting plate 21 is base plate 40 with means 30 therebetween for adjusting the height of the base plate 40.

The means 30 comprises two telescoping cylindrical members 31 and 32 and a height adjusting screw 33 which is threadably engaged with threaded member 34 which is fixedly attached to the base 40. In response to the rotation of the screw 33 which is effected by nut 38, the base plate 40 is moved towards and away from the mounting plate 21. The desired height of the base 40 is retained by means of a height locking screw 35 which passes through slot 36 in cylindrical member 31 and bore 37 of cylindrical member 32 and which is threadably engaged by nut 39. The tightening and loosening of the height locking screw 35 enables the fixing of the base 40 in its position or the enablement of it to be adjusted by the height adjusting screw 33, respectively.

In order to establish a pivot axis about which the burner will be angularly displaced, which is as close as possible to the burner nozzle 12, an inverted L-shaped mounting member 41 is provided which is fixedly connected at one arm 41*a* to base 40 and which extends vertically upwardly and has arm 41*b* which extends horizontally outwardly away from base 40. Fixedly mounted to the outwardly extending end of arm 41*b* is a pivot hinge 42 which receives a hinge pin 43 which defines the pivot point for the burner body 13 as will be explained hereinafter.

Also fixedly connected to the pivot hinge 42 is pivot arm 44 which is connected at one end thereto and which has connected at the other end portion thereof, a receiving member 45. The receiving member 45 has an internal configuration which is frustoconical and which is configured to closely receive the frustoconical locating member 11 on burner 10. The configuration of the members 11 and 45 are such that the burner nozzle is always located at a given distance from the receiving member 45 whenever the burner 10 is removed and subsequently replaced into the mounting 20. In the preferred embodiment, the leftmost edge of the locating member 11 is flush with the leftmost edge of the receiving member 45 when completely received therein, however, the above-mentioned repeatability will be achieved if the edges are flush or if the leftmost edge of the locating member 11 extends outwardly from the leftmost edge of the receiving member 45.

In order to releasably maintain the burner in position in the receiving member 45, releasable locking means 50 are provided which comprises a pushing member 52 which has a substantially U-shaped configuration and which extends around the burner body 13 but presses on the leftmost edge of the locating member 11. This pressing is accomplished by locking lever 51 which is pivotally mounted on the end of pivot arm 44 opposite the end connected to the hinge pin 43. When the lever 51 is pivoted in the counterclockwise direction, the pressing member 52 slides around the burner body 13 and presses against the locating member 11 pushing it into its final position in the receiving member 45. When the locking lever 51 is pivoted in the clockwise direction, the pressing member 52 is pivoted out of the way of the burner body 13 and the locating member 11 such that the burner 10 can be easily removed by merely pulling same out of the receiving member 45. Thus it can be clearly seen that the sole connection to the burner 10 is at the locating member 11 which facilitates a quick removal by even the most unskilled operator.

The lever 51 can be locked into the position shown in solid lines in FIG. 1 by the locking eccentric mounting thereof comprising pivot shaft 53, eccentric bush 54, nut 55 and the eccentric bush locking screw 56. Since the axis of rotation of shaft 53 is eccentric to that of bush 54, lever 51 is held in the locked position as a result of the pressure between members 11 and 52 and the fact that the line of pressure passes through the axis of rotation of bush 54.

In order to effect the angular displacement of the pivot arm 44 and therefore the burner 10 which is mounted therein during use, angle adjusting means 60 is provided which comprises angle adjusting screw 61 which is pivotally mounted to base 40 by support member 64, pivot pin 63 and locking nuts 68 and 69. The screw 61 is rotatably mounted on shaft 63 and prevented from any substantial longitudinal movement with respect thereto by collar 62 and locking nuts 65. The other end of screw 61 is pivotally mounted via member 66 which is rotatably mounted on member 67 which is also fixedly connected to pivot arm 44. Screw 61 is threadably engaged in member 66 and as a result of collar 62 which effects rotation of screw 61, the distance between pivot arm 44 and base 40 is changed, thereby pivoting same about pivot pin 43.

When the burner 10 is locked into mounting 20, the firing angle of the burner nozzle 12 can be changed by the adjustment of the angle of the pivot arm in conjunction with the adjustment of the height of the pivot axis, which gives one two degrees of freedom and enables any firing angle to be obtained.

What is claimed is:

1. In a furnace firing system of the type having a furnace port, a burner including a nozzle at one end received in the port and means for mounting the burner to position the nozzle in the port at a desired firing angle, the improvement wherein: the burner comprises an elongated body having a frustoconical locating member fixedly mounted therearound adjacent the other end of the burner and tapering towards the one end; and wherein the mounting means comprises means connecting to the burner solely at the locating member comprising a receiving member having the inner surface thereof configured to closely receive the locating member, means for releasably retaining the locating member in the receiving member and means for pivoting the burner about a pivot axis disposed between the locating member and the nozzle and substantially adjacent the nozzle comprising a pivot arm extending between the pivot axis and the receiving member and connected to the receiving member at one end, a base and a mounting member connected to the base at one end and pivotally connected at its other end to the other end of the pivot arm at the pivot axis to enable the pivot arm to pivot about the pivot axis with respect to the mounting member.

2. The system according to claim 1, further comprising means connected between the pivot arm and the base for adjusting the angular position of the pivot arm about the pivot axis and thereby that of the burner nozzle and means for adjusting the height of the base and thereby that of the burner nozzle.

3. The system according to claim 2, wherein the releasably retaining means comprises a locking lever pivotally connected to the pivot arm, a pushing member connected to the locking lever and movable towards the locating member to push same into position in the receiving member wherein the locking lever is pivotally mounted with a locking eccentric to effect the locking in position of the pushing member against the locating member.

4. The system according to claim 3, wherein the height adjusting means comprises a mounting plate a first cylindrical member connected at one end thereto, a second cylindrical member configured to be slidably received in the first cylindrical member and connected at one end to the underside of the base and height adjusting screw threadably engaged with the base to effect vertical movement of the base in response to rotation thereof.

5. The system according to claim 4, wherein the means for adjusting the angular position of the pivot arm comprises an angle adjusting screw pivotally mounted on both the base and the pivot arm at opposite ends thereof and threadably engaged with the pivotal mountings thereof to effect movement of the pivot arm towards and away from the base in response to rotation thereof.

6. The system according to claim 1, wherein said mounting member comprises an inverted L-shaped element with one arm extending vertically from the base and the other arm extending horizontally outwardly to said pivot axis.

* * * * *